US005249451A

United States Patent [19]

Aranovsky et al.

[11] Patent Number: 5,249,451

[45] Date of Patent: Oct. 5, 1993

[54] METHOD AND ARRANGEMENT FOR DIE FORGING ELONGATED WORKPIECES BY MULTISTATION PRESS TOOL

[76] Inventors: Viktor A. Aranovsky, ulitsa Nikitina, 62, kv.66; Gennady F. Zaitsev, ulitsa Bolshevistskaya, 175/6, kv.105., both of, Novosibirsk, U.S.S.R.

[21] Appl. No.: 853,982

[22] Filed: Mar. 20, 1992

[30] Foreign Application Priority Data

Mar. 23, 1990 [SU] U.S.S.R. ..... 4820381

[51] Int. Cl.[5] ..... B21J 13/10

[52] U.S. Cl. ..... 72/361

[58] Field of Search ..... 72/344, 356, 360, 361, 72/377

[56] References Cited

U.S. PATENT DOCUMENTS 3,713,320 1/1973 Andresen ..... 72/361

FOREIGN PATENT DOCUMENTS 550211 4/1977 U.S.S.R. .

570445 9/1977 U.S.S.R. .

588053 1/1978 U.S.S.R. .

*Primary Examiner*—Lowell A. Larson

*Attorney, Agent, or Firm*—Ladas & Parry

[57] ABSTRACT

Workpiece is placed in press tool and fastened to die parting plane. Lateral force is applied only to end portions of the workpiece to extrude workpiece metal to grips and form wedged fins. Grips engage with fins to carry workpiece to stamping stations.

Arrangement for die forging elongated workpieces has die, punch, and grips at either side of the die. Grips are locked by stop members to prevent relative displacement. Punch has cavity to receive workpiece and chamfered portions. Punch can engage with the die.

12 Claims, 2 Drawing Sheets

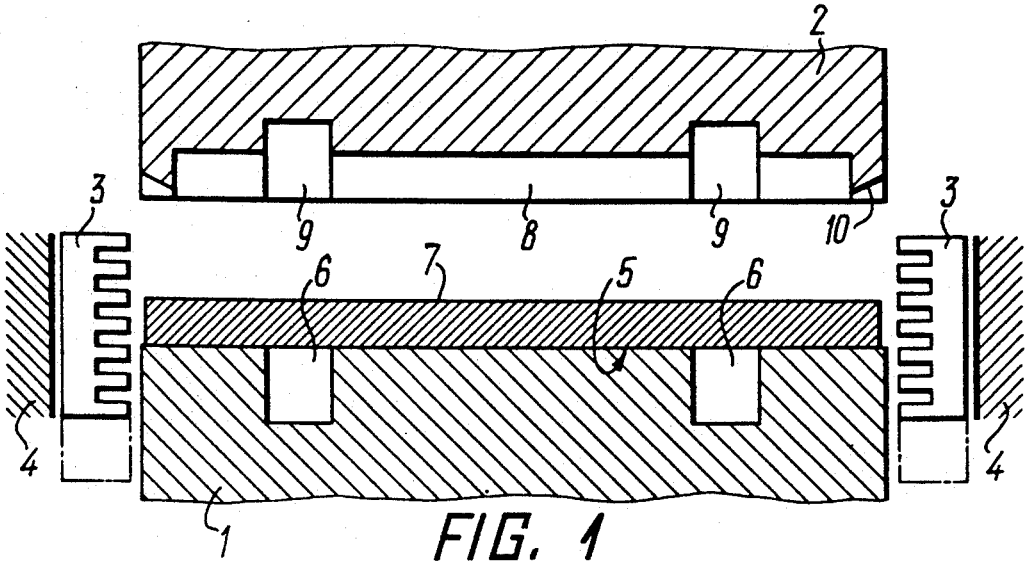
FIG. 1
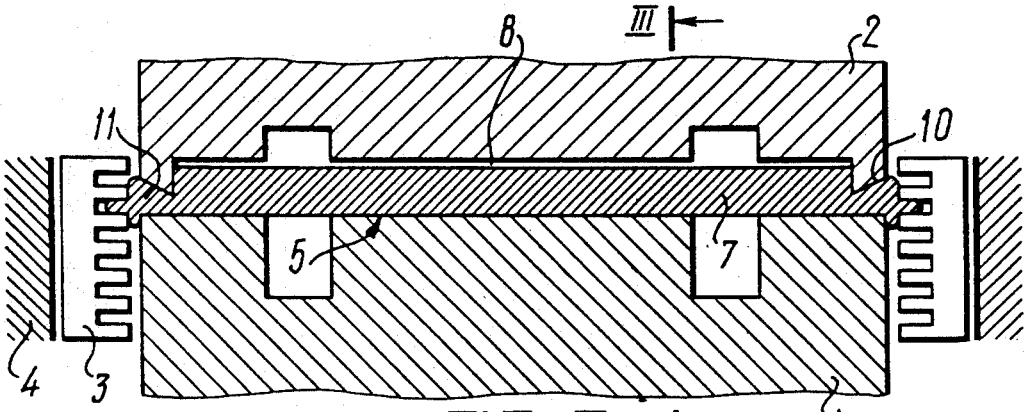
FIG. 2 III
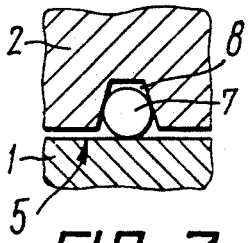
FIG. 3

METHOD AND ARRANGEMENT FOR DIE FORGING ELONGATED WORKPIECES BY MULTISTATION PRESS TOOL

FIELD OF THE INVENTION

This invention relates generally to mechanical working of metals, and more particularly to a method for die forging elongated machine parts by multistation press tools and arrangement for carrying out the method.

The invention can be used with success in press forging, as well as for fabricating bunch tool kits, surgical instruments, and making parts and units associated with mechanical and automative engineering obtainable only by swaging hammers.

BACKGROUND OF THE INVENTION

There is known a method to fabricate parts by die forging (cf., SU, A, 570445) residing in that a workpiece is conveyed to a press tool to be die-stamped, clamped by grips engaging with part fins at opposite sides relative to a die impression, removed from the press tool, and transferred for subsequent machining.

However, one disadvantage of the method is that the fins tend to flow arbitrarily through the perimeter of the workpiece, whereas grips are positioned at ends of the workpiece. This in turn results in insufficient quantity of metal extruded toward the grips. Fins are therefore rather thin tending to break during workpiece transfer and leading to an excess of rejects. This prior art method is impossible to use in multistation dies.

The above disadvantages are obviated in a method of die forging (cf., SU, A, 923693) which involves positioning grips at axially opposite workpiece ends to stamp workpiece ends so that part of the metal is caused to flow to the grips and engage therewith. Then the workpiece is raised and transferred by the grips to successive stamping positions. However, workpiece metal tends to flow uniformly to all sides including the central portion resulting in deflection of the workpiece. This deflection affects accuracy of workpiece positioning at successive stations of the press tool which leads to rejection because the central part of the workpiece may fail to rest over the preferred press position. Uniform spread of metal to all sides when stamping end workpiece portions leads to insufficient quantity of metal entering the grips, whereby the grips can fail to reliably hold and transfer the workpiece. At successive press stations the engagement point of the workpiece with the grips can also be deflected, as the midportion of the workpiece is not subjected to stamping and its thickness is greater than the thickness of the workpiece ends, whereas the workpiece is positioned according to the stamped ends, and the grips are lowered for the midportion to bear on the die impression.

The aforedescribed method is materialized in an apparatus (cf., SU, A, 923693) comprising a die, a punch engageable with the die, and grips at either side of the die having the form of endless chains and capable of vertical and horizontal displacement. However, the apparatus features all inherent disadvantages of the prior art method.

SUMMARY OF THE INVENTION

One object of the present invention is to provide a method and machine for die forging elongated parts by a multistation press forging tool ensuring reliable engagement of a workpiece with grips through extrusion of metal to the grips.

Another object is to provide a simple and reliable die forging arrangement ensuring accurate positioning of the workpiece when transferring it to successive stations.

One more object is to provide a method which would be more efficient and a machine which would be simpler in construction.

These and other objects and accompanying advantages are attained in a method for die forging elongated workpieces by a multistation press tool, a workpiece is placed in a die and fixed at die parting plane. Then a lateral force is applied exclusively to end portions of the workpiece to extrude metal longitudinally, and the flow of metal to the workpiece center is restricted to prevent the workpiece from deflection. Extruded metal is directed to grips to ensure more reliable engagement therewith. Then the workpiece is transferred from one press tool position to the next by said end grips.

One advantage of the proposed method is higher quality of the end product thanks to ensuring higher positioning accuracy. Restricting the flow of metal to the center of the workpiece allows one to avoid deflection of the workpiece during fin formation. As metal is extruded into the grips, the workpiece is made fast on the die parting plane to prevent bridging of the workpiece over the die at successive stations and, as a consequence, to avoid deflection of engagement points of the workpiece with the grips resulting in more reliable grip holding capacity. Another advantage of the method is high efficiency and simplicity, because such intricate units for transferring workpieces as manipulators can be dispensed with.

To ensure higher reliability and stronger bond between the extruded metal and the grips, it is preferable that the length of the end portions to which force is applied be not more than one-half the thickness of the workpiece, because a shorter and thicker end portion can withstand a greater weight of the workpiece. Conversely, when it is substantially less than one-half the workpiece thickness, the gravity force of the workpiece can break it off the grips during transfer to a successive press tool station.

In addition, higher reliability of engagement between the workpiece and the grips is ensured by the flow of metal predominantly towards the grips. This is effected by applying a gradually reducing force to the ends of the workpiece.

When forming a bond between the workpiece ends and the grips, a small quantity of metal tends to flow toward the workpiece resulting in possible deflection of the workpiece and less accurate positioning at successive press stations. Therefore, it is advisable to protect the workpiece against deflection in two orthogonal directions by applying a force in these directions lengthwise of the workpiece.

The proposed method can be carried cut in a machine for die forging elongated workpieces by a multistation press tool which comprises a die and a punch engageable with the die. Grips are arranged at either side of the die for vertical movement and horizontal displacement. The die has a cavity corresponding to the size of the workpiece. Ends of the punch facing the grips have chamfered portions in cross section to form grooves diverging toward the grips to ensure predominant flow of metal toward the grips.

For the sake of structural simplification it is preferable that the grips be fashioned as endless racks. This can substantially simplify positioning of the grips relative to die impressions.

BRIEF DESCRIPTION OF THE DRAWINGS

The invention will now be described in greater detail with reference to specific embodiments thereof taken in conjunction with the accompanying drawings, in which:

FIG. 1 is a sectional view of the machine illustrating relative position of die, punch and grips at a point when the workpiece is conveyed to the press tool to be placed on a die parting plane;

FIG. 2 is a sectional view of the press tool when the workpiece is engaged with grips;

FIG. 3 is a cross section taken along line III—III in FIG. 2;

DETAILED DESCRIPTION OF THE INVENTION

Figure 4:
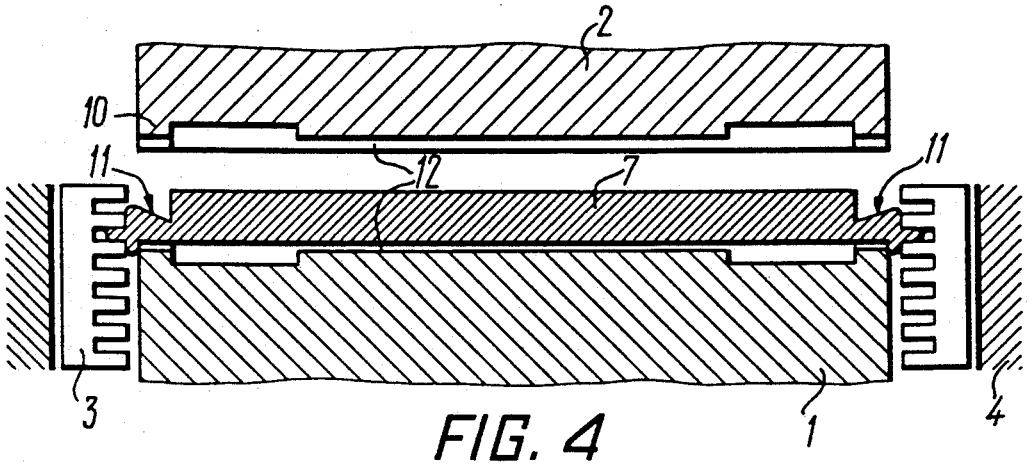
FIG. 4 is a sectional view of the press tool when the grips place the workpiece on a die impression.
Figure 5:
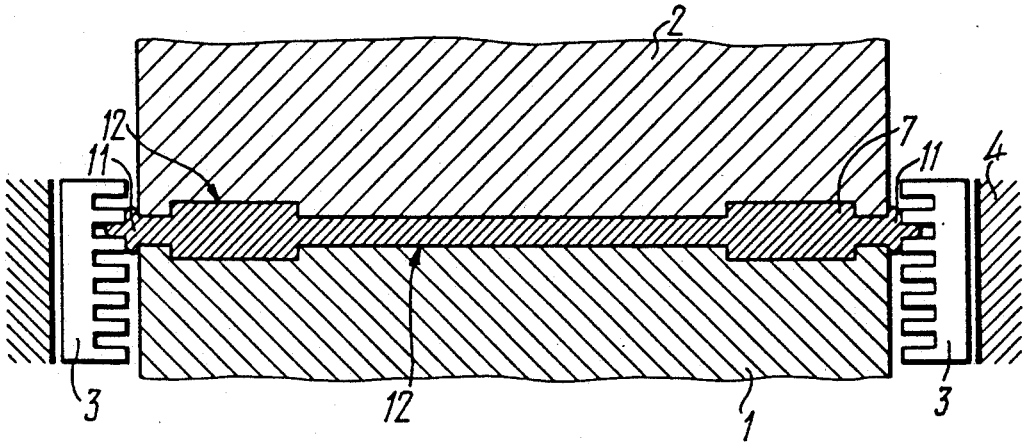
FIG. 5 is a sectional view of the press tool at the point of impact to form the workpiece.

Hereinafter in the description like elements in all Figures are indicated by like reference numerals.

Referring now to FIG. 1 showing the simplest modification of the proposed machine for die forging elongated workpieces, the operating principle of the machine will be described to more fully understand the method according to the invention.

The machine has a die 1 and a punch 2 positioned over die 1 to engage therewith.

Provided at either side of die 1 are grips 3 in the form of flexible endless racks made up of separate rigid links successively joined and closed into a ring. Grips 3 are mounted on stops 4.

Stops 4 retain grips 3 against relative longitudinal displacement in the plane of the drawing. Grips 3 are capable of translational motion in the horizontal plane relative to the die and reciprocation in the horizontal plane. Movements of the two grips 3 are synchronized. Die 1 has a die parting plane 5, i.e., part of die surface facing punch 2 having no die impression. This die parting plane 5 is used to accommodate a workpiece 7 at the initial stamping stage thereby functioning as a first stamping station. Workpiece 7 is admitted to and retained at the first station by two gates (not shown) received in grooves 6 of die 1.

Punch 2 positioned over the first stamping station has a cavity 8 corresponding to the size of workpiece 7 to protect workpiece 7 against deflection in the course of stamping. Punch 2 also has grooves 9 to accommodate gates which retain workpiece 7 at die parting plane 5 during punch impact. End portions of punch 2 at the side of the grips are chamfered to form grooves 10 diverging laterally in the plane of the drawing toward grips 3 to ensure that workpiece metal is extruded predominantly toward grips 3.

Stamping is carried out in the following manner.

At the first stamping station, workpiece 7 is joined with grips 3. With this aim in view, steel workpiece 7 heated to 1000°-1200° C. is conveyed by gates (not shown) to the press tool to be fixed in place directly at the die parting plane 5. The gates are positioned in grooves 6 of die 1. Prior to and at the point of impact delivered by punch 2, grips 3 at the ends of die 1 in the flow path of metal longitudinally of workpiece 7 tend to assume a low position (FIG. 2).

Workpiece 7 is joined with grips 3 by virtue of impact deformation (laterally in the plane of the drawing), i.e., in a direction perpendicular to die parting plane 5. Lateral force is applied only to end portions of workpiece 7, i.e., only end portions of punch 2 and grooves 10 are brought in engagement with workpiece 7. Provision of the grooves 10 diverging toward grips 3 allows application of force to end portions of workpiece 7 while gradually reducing this force toward the ends of workpiece 7. This facilitates extrusion of metal toward grips 3 thanks to reduced force applied in this direction. This advantageous effect is accompanied by a substantially reduced tendency of metal to flow toward the center of workpiece 7.

As punch 2 is brought to its lowest position (FIG. 2), grooves 10 direct metal flow to grips 3 for the metal to enter the interior of grips 3 and form wedge-shaped fins 11. At this point the workpiece rests in cavity 8 of punch 2. Cavity 8 is trapezoidal in cross section (FIG. 3) for its side walls to engage with the workpiece, which in turn ensures application of force in two orthogonal directions lengthwise of workpiece 7.

It has been found experimentally that for reliable connection of workpiece 7 to grips 3 the length of the end portion of workpiece 7 to which the force is applied and, accordingly, the length of groove 10 is not in excess of one-half the thickness of the end product. The length of fin 11 completely corresponds with the weight of the workpiece to avoid inadvertent breaking of fins 11 from the interior of the grips during subsequent transfer to and stamping at successive stamping stations.

After engaging the workpieces with grips 3, punch 2 is raised to allow grips 3 (FIG. 4) to move vertically and raise workpiece 7 from the die parting plane 5.

Then grips 3 move horizontally to set workpiece 7 over first die impression 12 of die 1 followed by lowering workpiece 7 onto the die parting place 5. Now workpiece 7 rests at second stamping station. At this station punch 2 also die impression 12, whereas grooves 10 are rectangular for partially reshaping the fins. Such an arrangement of the grooves 10 allows extrusion of an extra quantity of metal to grips 3 to strengthen the bond between the workpiece and grips 3 and more reliably retain the workpiece during stamping.

When workpiece 7 assumes the position at the second stamping station, another workpiece is admitted to first stamping station, after which the cycle is repeated. When the stamping of workpiece 7 at the last stamping station is terminated, the thus obtained forged workpiece is removed by grips 3 from the working zone of the press.

It is obvious from the aforedescribed that the method for die forging elongated workpieces by a multistation press tool involves placing the workpiece in the die at its die parting plane, and applying lateral force only to end portions of the workpiece to extrude workpiece metal longitudinally of the workpiece while simultaneously restricting the flow of metal in a direction toward the center of the workpiece. The metal thus extruded is caused to flow toward the grips to provide the bond between the workpiece and the grips and at the same time protect the workpiece against deflection. Then the workpiece is carried by the grips to successive stamping stations.

The proposed method ensures that workpiece can be connected to the grips for 0.02-0.001 seconds. Workpieces are moved from one stamping station to another during the work stroke of the punch. The time of contact between workpiece and die is as short as 0.1–0.2 seconds. End forged piece is obtained within a space of time depending largely on the number of stamping stations, such as 2.8 seconds when the press tool has four stamping stations.

Described heretofore have been preferred embodiments of the invention, although it stands to reason to assume that alterations can be made within the spirit and scope of the invention; for example, the grips can be fashioned as endless leaf chains, with leafs having additional grooves to facilitate engagement between the workpiece and the grips.

What is claimed is:

1. A method of die forging elongated workpieces in a multi-station press comprising:

placing a substantially straight workpiece on a parting plane surface of a die, applying a pinch onto the workpiece to press and extrude metal at opposite ends of the workpiece simultaneously, receiving a middle portion of said workpiece in a cavity provided in said punch, when the punch is applied onto the workpiece, so that when the ends of the workpiece are pressed, the remainder of the workpiece will be maintained in a substantially straight condition on said parting place surface, positioning grips at the opposite ends of the workpiece to receive the the metal extruded therefrom upon application of said punch to form a bonded connection therewith, and removing the workpiece from the parting plane surface of the die for placement at a subsequent station of the press by displacing said grips.

2. A method as claimed in claim 1 comprising forming said cavity with inclined walls to engage said workpiece and prevent displacement thereof parallel and perpendicular to said parting plane surface.

3. A method as claimed in claim 1, wherein said punch is formed with a tapered surface facing said parting plane surface of the die for pressing and extruding the metal at the ends of the workpiece to produce projecting fins at said ends having lower surfaces coextensive with the lower surface of the workpiece placed on the parting plane surface.

4. A method as claimed in claim 1, wherein said cavity confines on said workpiece to prevent deflection of the workpiece when said ends are being pressed and extruded.

5. A multistation press for die forgoing elongated workpieces comprising:

a die having a parting plane surface for receiving a substantially straight workpiece thereon;

a displaceable punch positioned above said die, said punch being displaceable onto said workpiece and including punch means for applying force at opposite ends of the workpiece to press said ends and simultaneously extrude metal laterally outwards of said ends;

means on said punch for engaging a middle portion of the workpiece to prevent deflection of said middle portion, when the ends of the workpiece are pressed, and thereby maintain the workpiece substantially straight, and movable grips adjacent to said die in facing relation with the opposite ends of the workpiece to receive the metal extruded at said ends and form a bonded connection with the workpiece thereat, said grips being movable to transport the workpiece therewith to a subsequent station of the press.

6. A press as claimed in claim 5, wherein said means for engaging a middle portion of the workpiece comprises a cavity in said punch into which the middle portion of the workpiece is received when said ends are being pressed.

7. A press as claimed in claim 6, wherein said cavity has opposite walls which are inclined.

8. A press as claimed in claim 7, wherein said walls converge in a direction away from said parting plane surface.

9. A press as claimed in claim 5, wherein said punch and said die have grooves between the middle portion of the workpiece and said punch means.

10. A press as claimed in claim 5, wherein said grips each comprises a chain.

11. A press as claimed in claim 10, wherein said chain is in the form of a rack.

12. A press as claimed in claim 5, wherein said punch means comprises at each end of the punch a projecting having a chamfered end facing said parting plane surface of said die.

* * * * *